United States Patent [19]

Mayer et al.

[11] Patent Number: 4,761,120

[45] Date of Patent: Aug. 2, 1988

[54] WELL PUMPING UNIT AND CONTROL SYSTEM

[76] Inventors: James R. Mayer, 7558 S. Rosemary Cir., Englewood, Colo. 80112; Robert T. Sparkman, Jr., 107 Harper's Ferry, Victoria, Tex. 77904

[21] Appl. No.: 877,468

[22] Filed: Jun. 23, 1986

[51] Int. Cl.[4] ..... F04B 47/04

[52] U.S. Cl. ..... 417/403; 91/275; 92/137; 60/376

[58] Field of Search ..... 417/404, 403; 91/275; 60/369, 371, 376; 92/137; 137/625.6, 625.66, 625.69

[56] References Cited

U.S. PATENT DOCUMENTS

| | | | |
|---|---|---|---|
| 2,536,965 | 2/1951 | Taylor | 137/625.66 |
| 3,939,656 | 2/1976 | Goldfein | 60/381 |
| 3,986,355 | 10/1976 | Klaeger | 60/369 |
| 4,198,820 | 4/1980 | Roth et al. | 60/372 |
| 4,305,461 | 12/1981 | Meyer | 166/84 |
| 4,430,924 | 2/1984 | Dunn et al. | 60/369 X |
| 4,432,706 | 2/1984 | Gilbertson | 91/275 X |
| 4,438,628 | 3/1984 | Creamer | 91/275 X |
| 4,512,149 | 4/1985 | Weaver | 91/275 X |
| 4,530,645 | 7/1985 | Whatley et al. | 91/275 X |

*Primary Examiner*—Leonard E. Smith

*Attorney, Agent, or Firm*—Michael E. Martin

[57] ABSTRACT

A well pumping unit comprising a double acting hydraulic cylinder actuator supported on a mast above a wellhead and having a piston rod connected directly to the polish rod of an elongated subsurface pump rod string. A generally cylindrical annular counterweight is disposed around the mast and is interconnected with the cylinder actuator by flexible chains trained over crown sheaves and travelling sheaves connected to the upper piston rod offsetting the weight of the pump rod string and at least a portion of the weight of the fluid column in the well. The pumping unit is controlled by a hydraulic control system including a directional control valve and flow control valves for selectively controlling the strokes of the cylinder actuator. A hydraulic pressure load sensing system measures total load on the rod string and provides for automatic shutdown of the actuator if the fluid level in the well is pumped below a predetermined level. The counterweight includes a tank for receiving a selected amount of liquid which may be pumped into or out of the tank by a reversible motor driven pump controlled by a circuit which senses an imbalance in the working pressures of the hydraulic fluid being supplied to the cylinder actuator to correct the effective weight of the counterweight for changes in fluid density and lifting effort of the actuator.

32 Claims, 6 Drawing Sheets

WELL PUMPING UNIT AND CONTROL SYSTEM

BACKGROUND OF THE INVENTION

1. Field of the Invention

The present invention pertains to a well pumping unit for operating a downhole, rod actuated oil well pump and the like. The well pumping unit includes a control system which includes means for sensing the lifting effort on the pump rod, controlling an operating cycle of the pumping unit and for varying the effective weight of a counterweight system.

2. Background

Various types of well pumping units for operating downhole positive displacement well pumps, also known as sucker rod pumps, have been developed. The most common type of well pumping unit comprises a walking beam mechanism which reciprocates the elongated pump rod or sucker rod string and is driven by an electric motor or internal combustion engine through a gear reduction mechanism including, in some cases, a counterweight system. There are several desiderata which have not been met by prior art pumping systems. For example, it is desirable to provide a well pumping unit which is easily set up at the well site and is easily connected to and disconnected from the elongated pump rod string so that servicing of the pumping unit itself or workover of the well may be easily performed. It is also desirable to minimize the stresses on the elongated pump rod string to reduce the change of pump rod or downhole pump failure.

In particular, the pumping of low productivity oil wells, sometimes referred to as stripper wells, requires a pumping unit which is economical to operate and can be controlled to avoid overpumping the well. Many oil bearing formations produce gases, water and other fluids which are mixed in with the produced crude oil. These fluids affect the lifting requirements of the pumping unit and the rate of flow of fluids in the wellbore is often erratic and inconsistent, particularly informations which are being subjected to enhanced recovery operations or are nearing the end of their productive life.

All of the above mentioned requirements and desired features in well pumping units have not been met by prior art type pumping units and control systems therefor. It is to this end that the present invention has been developed with a view to providing an improved well pumping unit and control system which is reliable in operation, economical to manufacture, and easily adapted to operate efficiently for lifting crude oil and other well fluids from formations which have erratic production characteristics or are marginally productive.

SUMMARY OF THE INVENTION

The present invention provides an improved well pumping unit of a type wherein an elongated hydraulic cylinder actuator mechanism is directly connected to the pump rod string for reciprocating the pump rod or sucker rod.

In accordance with one aspect of the present invention, a pumping unit is provided which may be conveniently mounted on a lightweight frame or skid and may be easily connected to and disconnected from the so called polished rod of an elongated pump rod string, and the pumping unit may be easily set back from the well to permit well servicing and workover operations. In accordance with another aspect of the invention, a well pumping unit of the reciprocating hydraulic cylinder actuator type is provided which has a unique arrangement of a counterweight connected to the hydraulic cylinder actuator which provides a compact arrangement of mechanism, provides for the application of mechanical forces generally in a direction along the longitudinal central axis of the pumping unit and the pump rod string and provides a combination of mechanism which is mechanically uncomplicated, relatively easy to manufacture and economical in operation. Certain improvements in reciprocating hydraulic cylinder type pump actuating mechanism are provided such as improved means for adjusting the alignment of the cylinder actuator with the polished rod and a cylinder piston and piston rod construction which permits convenient connection of the actuating cylinder to the polished rod and disconnection therefrom.

The present invention stil further provides a unique control system for actuating a well pumping unit wherein the load on the pumping unit during a lifting stroke may be sensed and may be utilized to control operation of the pumping unit to prevent over pumping the well and to minimize the actuator lifting efforts. The present invention also includes a unique variable counterweight system in combination with a control system which adjusts the effective weight of the counterweight in accordance with the load on the pump actuating mechanism to minimize the power requirements for operating the pump actuating mechanism and to balance the actuating forces on the pumping unit.

The present invention still further provides a control system for operating a reciprocating cylinder type pump actuating mechanism which includes a control valve for controlling the flow of fluid to and from a double acting hydraulic cylinder in such a way as to minimize dynamic load changes on the pumping unit and the pump rod string. The control system also includes features which provide for selective control of the lifting stroke and the downstroke of the pump rod string, means for sensing the load on the cylinder actuator and means to provide for reliable operation of a hydraulic cylinder type well pumping unit.

The abovementioned advantages and aspects of the present invention, as well as additional superior features thereof, will be further appreciated by those skilled in the art upon reading the detaile description which follows in conjunction with the drawing.

DESCRIPTION OF THE PREFERRED EMBODIMENTS

Figures 1, 2:
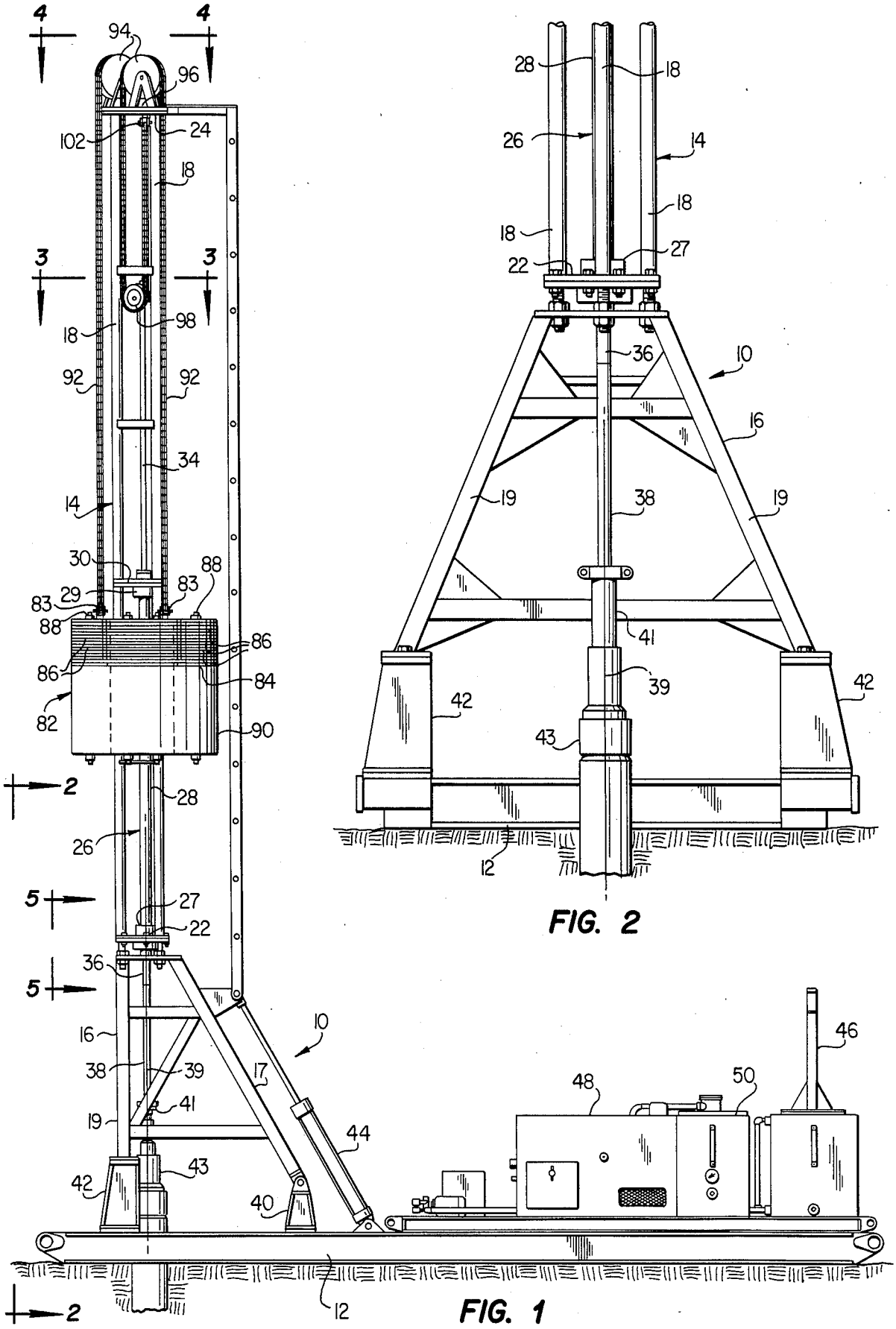
FIG. 1 is a side elevation of the well pumping unit of the present convention.
FIG. 2 is a partial front end view of the pumping unit.

In the description which follows, like parts are marked throughout the specification and drawing with the same reference numerals, respectively. The drawing figures are not necessarily to scale and certain features of the well pumping unit and the control system are shown in schematic form using conventional circuit diagram symbols in the interest of clarity and conciseness.

Referring to FIGS. 1 and 2, the well pumping unit of the present invention is generally designated by the numeral 10, includes a conventional skid or frame 12 which supports an elongated vertically extending mast 14 and which is disposed on a subframe 16. The mast 14 is preferably characterized by vertically extending spaced apart tubular column members 18 arranged in a triangular configuration and secured together by spaced apart braces 20, a base plate assembly 22 and a crown plate 24. The mast 14 supports an elongated double acting hydraulic cylinder and piston actuator 26 including a cylinder member 28 which is supported centrally in alignment with the longitudinal central axis of the mast 14 by a suitable connection between cylinder head members 27 and 29 at opposite ends of the cylinder member 28 and which may be removably connected to the base plate assembly 22 and an intermediate support plate 30.

Figure 6:
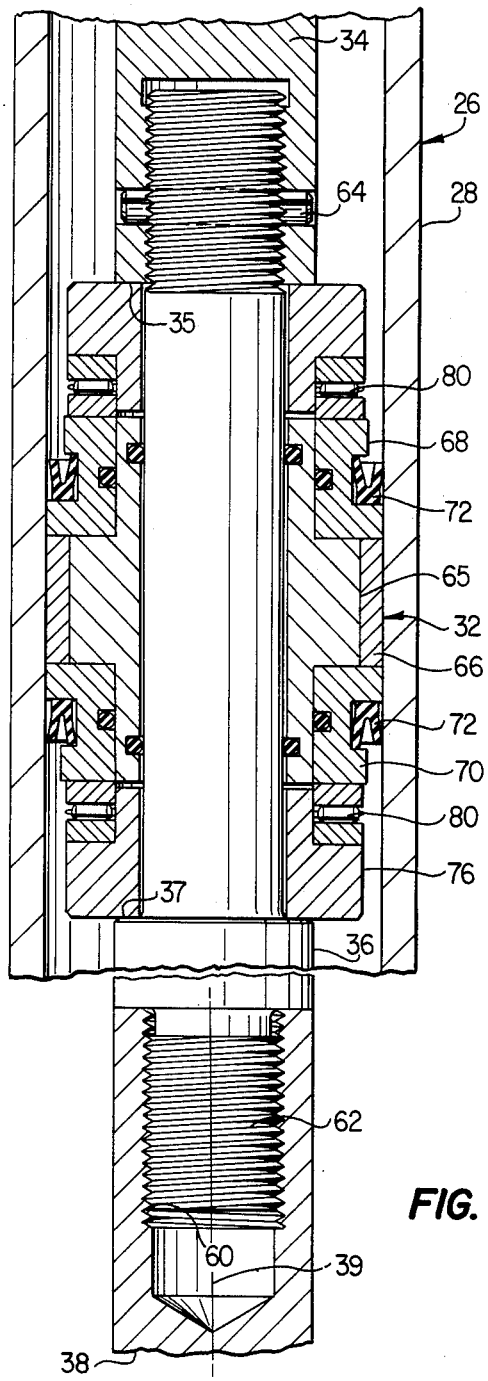
FIG. 6 is a central detail section view of the actuator cylinder and piston rod.

Referring briefly to FIG. 6, also, the actuator 26 includes a piston assembly 32, an upper piston rod 34 and a lower piston rod 36. The lower piston rod 36 is adapted to be removably connected to the polish rod 38 of a conventional elongated pump rod string which is connected at its lower end to a conventional subsurface or downhole positive displacement well pump which will be described in some further detail in conjunction with the control system illustrated in FIGS. 8A and 8B. Referring again to FIGS. 1 and 2, the mast subframe 16 includes spaced apart column members 17 which are pivotally secured to support legs 40 on the frame 12. The subframe 16 also includes a second set of spaced apart column members 19 which may be secured to support legs 42 by bolts or by a removable hinge pin type connection, not shown. The assembly of the subframe 16 and the mast 14 may be moved from an erect position shown in FIG. 1 to a reclining position away from the longitudinal central axis 39 of the pump rod string by a pair of hydraulic cylinder type erection jacks 44, one shown in FIG. 1, for moving the mast 14 between erect and reclined positions. The frame 12 preferably includes a support rack 46 for supporting the upper end of the mast 14 in its reclined position, not shown. The frame 12 also includes a housing 48 for enclosing a motor driven hydraulic pump to be described in further detail herein. A hydraulic fluid reservoir tank 50 is also disposed on the frame 12 for storing a suitable quantity of working fluid for the cylinder actuator 26. The polished rod 38 extends from a stuffing box 41 of a conventional wellhead 43.

Figure 5:
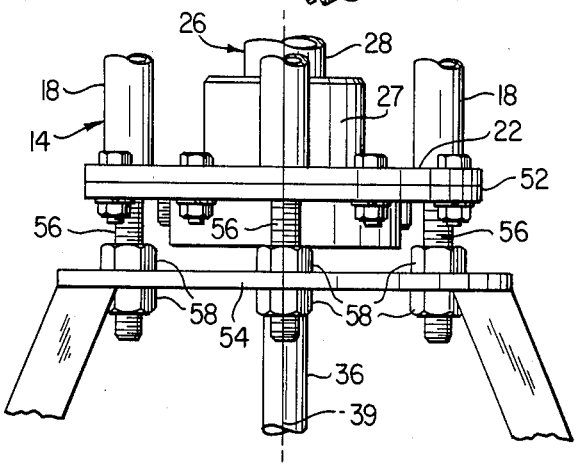
FIG. 5 is a detail view taken from the line 5—5 of FIG. 1.

Referring further to FIG. 2 and FIG. 5, the mast 14 and the actuator 26 are aligned with the axis 39 so that the central axis of the actuator 26 is substantially coincident with the centerline or axis 39 by an adjustable support plate 52 comprising part of the assembly 22 and which is supported on a transverse member 54 of the subframe 16 by three spaced apart threaded support members 56. The support members 56 extend through suitable openings in the member 54 and are connected thereto by upper and lower locknuts 58. By adjusting the position of the respective sets of locknuts 58 the mast 14 and the cylinder actuator 26 may be adjusted to be aligned with the centerline 39 of the polish rod 38 to minimize any lateral side loads on the piston rods 34 and 36 and the polish rod. This adjustment feature minimizes the requirement for precise leveling of the frame 12 when the pumping unit 10 is set up at a well which is to be operated by the pumping unit.

Another unique feature of the present invention provides for connecting and disconnecting the cylinder actuator 26 with respect to the polish rod 38. Referring again to FIG. 6, the upper end of the polish rod 38 is preferably provided with internal threads 60 for receiving an externally threaded portion 62 of the lower piston rod 36. The lower piston rod 36 extends into the cylinder 28 and through the piston assembly 32 and is threadly connected to the upper piston rod 34. The connection between the upper and lower piston rods may be reinforced by a lock pin 64 extending through the rods as shown in FIG. 6. In order that the piston rod assembly comprising the rods 34 and 36 may be rotated to threadedly connect and disconnect the cylinder actuator 26 with respect to the polish rod 38, the piston assembly 32 includes a central pistonmember 65 journaled in the bore of the cylinder 28 by a suitable sleeve bearing 66. Opposed seal support members 68 and 70 are disposed in sleeved relationship around the central piston member 65 and are adapted to support opposed piston seals 72 which are of a resilient lip type.

The piston assembly 32 further includes opposed bearing support members 74 and 76 which function to retain opposed roller type thrust bearings 80 in engagement with the seal support members 68 and 70, respectively. As illustrated in FIG. 6, the piston assembly 32 is secured in assembly by a shoulder 37 formed on the lower piston rod 36 and a transverse end face 35 formed on the upper piston rod 34. The arrangement illustrated in FIG. 6 provides for rotation of the assembly of the piston rods 34 and 36 together with the upper and lower bearing support members 74 and 76 without rotating the central piston member 65 or the seal support members 72 and 74. In this way the cylinder actuator 26 may be easily connected to and disconnected from the polish rod 38 and the entire pump rod string while requiring only rotation of the cylinder actuator piston rods 34 and 36.

Referring again to FIG. 1, the well pumping unit 10 includes a unique arrangement of counterweight means for assisting in the reciprocation of the pump rod string and comprising a generally annular counterweight member 82 which is disposed around the mast 14 and is linearly reciprocable along the mast. The counterweight 82 includes an annular support plate 84 for supporting a plurality of somewhat circular sector shaped counterweight plate members 86 which may be disposed in stacked relationship and secured to the plate 84 by upstanding threaded stud members 88. The counterweight 82 also includes a variable counterweight feature characterized by an annular fluid tank part 90 disposed below the counterweight support plate 84 and suitable secured thereto. The variable counterweight feature will be further described in conjunction with the control system for the pumping unit 10.

Figure 3:
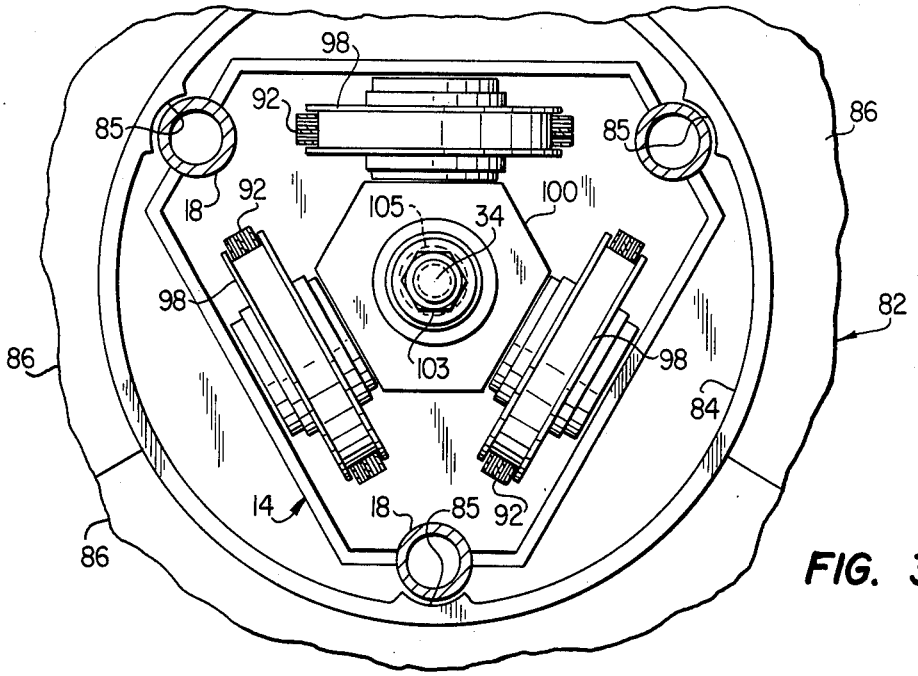
FIG. 3 is a section view taken along the line of 3—3 of FIG. 1.
Figure 4:
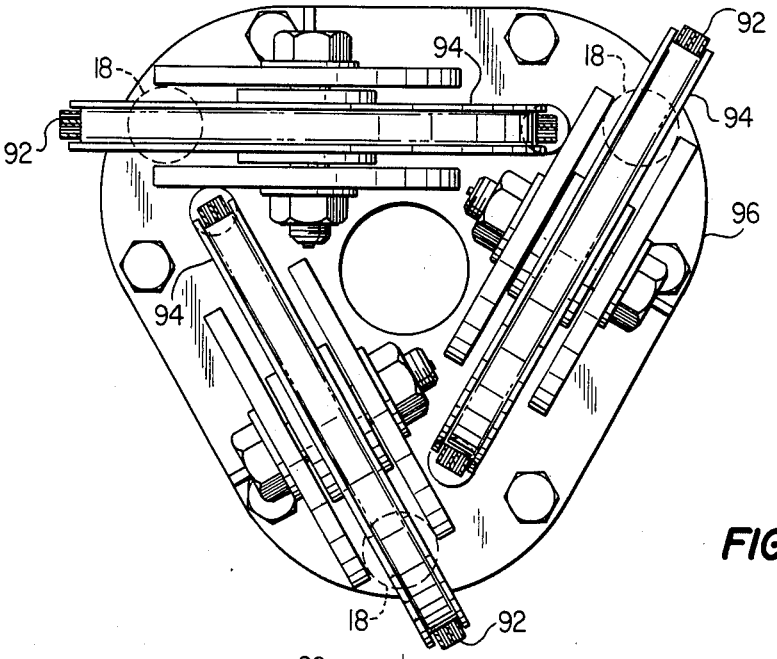
FIG. 4 is a plan view taken from the line 4—4 of FIG. 1.
Figure 7:
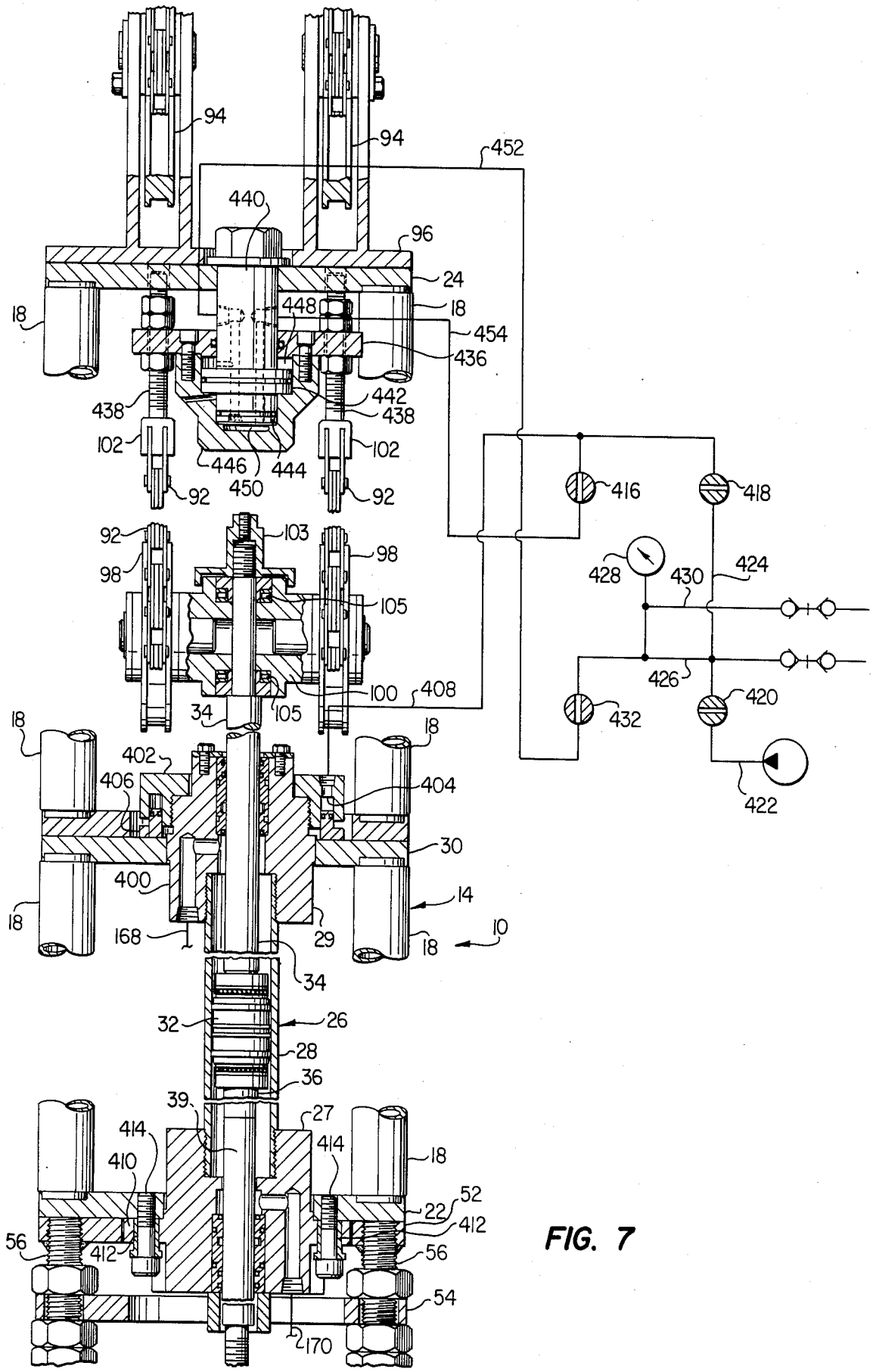
FIG. 7 is a view of a load sensing mechanism for the cylinder actuator.

The counterweight 82 is connected to the piston rod 34 by an arrangement of flexible members such as three elongated leaf chains 92 which are respectively secured to the counterweight member 82 at connectors 83, and extend over respective crown sheaves 94, see FIG. 4 also, which are rotatably supported on a support plate 96 suitably secured to the mast crown plate 24. The chains 92 are also each trained around respective traveling sheaves 98, see FIG. 3 also, which are supported on a support member 100 suitably secured to the distal end of the upper piston rod 34. The chains 92 are each anchored by anchor members 102, one shown in FIG. 1, supported from the crown plate 24. As illustrated in FIGS. 3 and 7, the support member 100 is connected to the upper end of the piston rod 34 by suitable means such as a nut 103 threaded over the upper end of the piston rod and bearings 105 are operably to support the member 100 on the upper end of the piston rod 34 so that the piston rod may be rotated relative to the support member 100 and the traveling sheaves 98 during connection and disconnection operations previously described for disconnecting or connecting the piston rod 36 with respect to the polish rod 38.

The particular arrangement of sheaves 94 and 98 and flexible chain members 92 interconnecting the counterweight 82 with the actuator 26 provides a mechanical advantage with respect to the effective weight of the counterweight 82 acting on the actuator 26. Moreover, the annular counterweight 82, which is substantially symmetrically arranged with respect to the longitudinal central axis of the actuator 26 and the mast 14, provides for directing all of the counterweight forces generally parallel to and coincident with this central axis which also coincides with centerline or axis 39 of the polish rod 38 and the pump rod string. As shown in FIG. 3, the counterweight 82 includes suitable spaced apart guide surfaces 85 formed on the plate 84 for guiding the counterweight along the mast tubes 18. Suitable grooved rollers may be used also, not shown. The utilization of commercially available industrial leaf chain is particularly advantageous since the sheaves 94 and 98 may comprise conventional grooved pulleys with sealed bearings and only minimal periodic lubrication is required for the chains 92. The flexible members represented by the chains 92 may also comprise roller chain or wire rope although the lubrication requirements of leaf chain and the minimal bending stresses exerted on these members as compared with wire rope auger well for their use for the pumping unit 10.

Figure 8A:
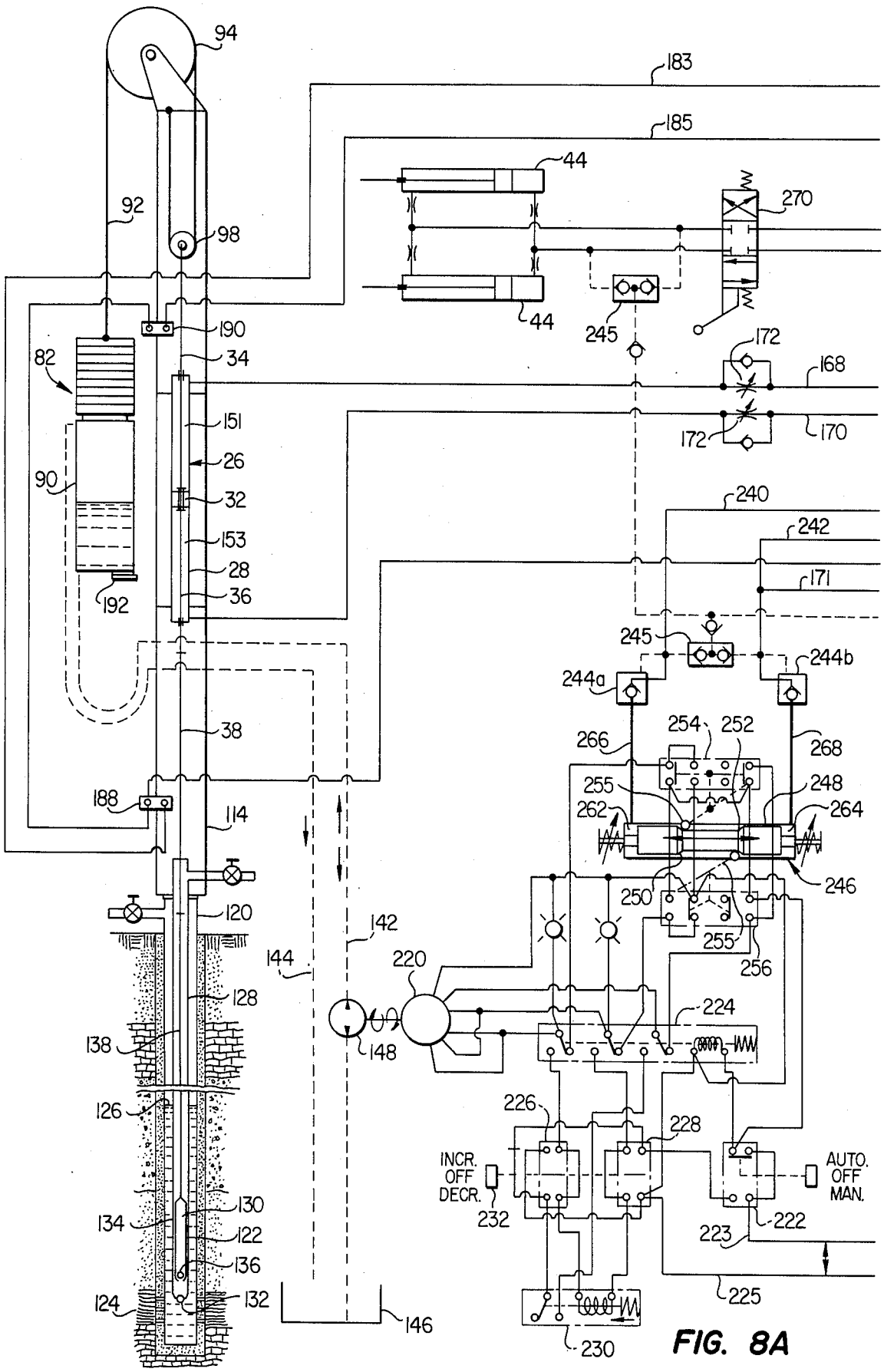
FIGS. 8A and 8B viewed together comprise a schematic diagram of a control system for the pumping unit.
Figure 8B:
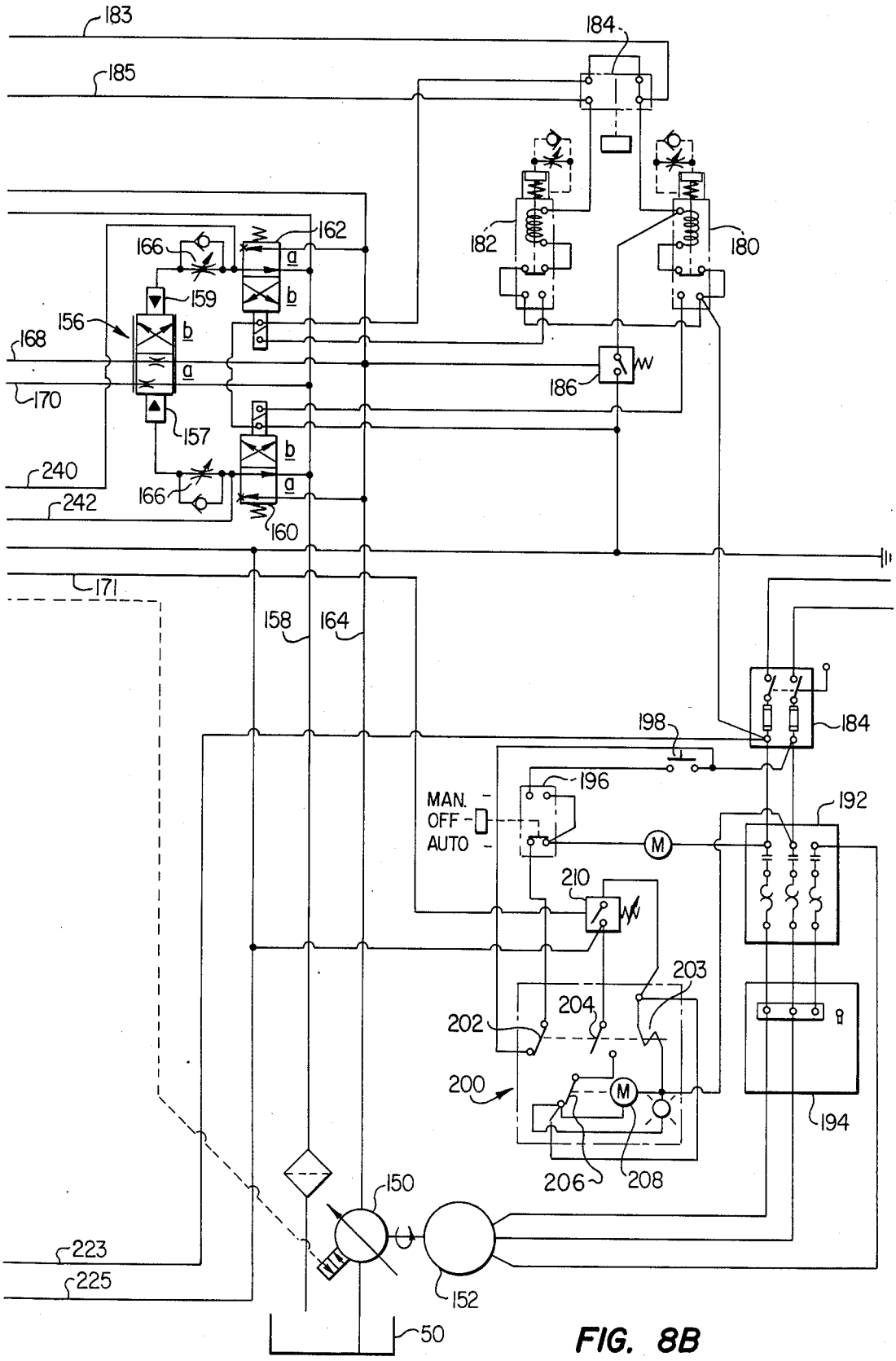

The actuator 26 is supplied with hydraulic fluid from a pump to be described in conjunction with the control system illustrated in FIGS. 8A and 8B to effect reciprocation of the piston rods 34 and 36 to lift the polish rod 38 and the pump rod string, not shown, connected thereto and which is assisted by movement of the counterweight 82 downwardly. Hydraulic fluid is also supplied to the actuator 26 to move the piston rod assembly 34,36 downwardly during a transfer or filling stroke of the subsurface pump to mvoe the counterweight 82 in the opposite or upward direction also. Normally the effective weight of counterweight 82 is provided by adding or subtracting counterweight plates 86 and filling or emptying the tank 90 with a liquid such as a water-antifreeze solution to provide the effective weight of the counterweight 82 to be equal to the weight of the entire pump rod string, the polish rod 38, and piston rod assembly 34,36 plus the weight of approximately ½ of the weight of the fluid column being lifted by the pumping unit 10.

In the normal operation of a well for lifting crude oil the subterranean formation may free flow to at least partially fill the wellbore. Moreover, the particular formation being produced may tend to produce other liquids having densities different from the crude oil, and gases may be dissolved in the liquids being produced which will affect the weight of the fluid column being lifted. The present invention includes an improvded and unique system for operating the cylinder actuator 26 which will now be described in conjunction with FIGS. 8A and 8B. Referring to FIGS. 8A and 8B, which are intended to be viewed together, the pumping unit 10 is shown in somewhat schematic form including a modified mast 114 which is illustrated as being mounted directly on a wellhead 120. The wellhead 120 includes a production casing 122 which extends into a subterranean formation 124 and is suitably perforated to allow well fluids to flow into the casing as indicated by the nominal fluid level 126. A production tubing string 128 extends into the well illustrated and has disposed at its lower end a conventional positive displacement subsurface pump 130 having a conventional standing valve 132, a piston 134 and a traveling valve 136. The piston 134 is connected to the actuator 26 through an elongated rod string 138 and including the polish rod 38 which extends from the wellhead 120. Well fluid is lifted through the tubing string 128 and is discharged at the surface through a suitable conduit 140.

The liquid tank 90 of the counterweight 82 is connected by way of flexible fluid conductors 142 and 144 to a source 146 of suitable liquid such as a water and ethylene glycol solution. A reversible pump 148 is in communication with the fluid source 146 and the conduit 142 for filling and emptying the counterweight tank 90 in accordance with operation of the control system to be described in further detail. The conduit 144 operates as an overflow conduit to return excess liquid to the source tank 146.

The actuator 26 is controlled for displacing the piston 32 by a unique control system including a flow and pressure compensated hydraulic pump 150 driven by a motor 152 which, for the exemplary control system described herein, is operated by 3-phase 240 V alternating current electric power. Hydraulic fluid is supplied by the pump 150 from reservoir 50 to the actuator 26 through a pilot-operated directional control valve 156. When the control valve 156 is in its position a, pressure fluid is supplied to chamber 151 of the cylinder actuator 26 to raise the counterweight 82 and to lower the pump piston 134 on a pump filling stroke. When the valve 156 is in position b pressure fluid is supplied to the actuator chamber 153 to lift the pump rod string 138 and a column of crude oil in the production tubing 128 with the assistance of the counterweight 82. Fluid is returned to the reservoir 50 through the valve 156 and by way of a return conduit 158. Respective pilot actuators 157 and 159 of the valve 156 are supplied with pressure fluid by respective solenoid operated spring return-type valves 160 and 162 which receive fluid from a high pressure fluid supply conduit 164 to deliver pressure fluid to the pilot operators 157 and 159, respectively. The conduits interconnecting the respective pilot valves 160 and 162 with the pilot actuators 157 and 159 have suitable needle type flow control valves 166 interposed therein and which are adjustable to advantageously control the shift speed of the valve 156. Moreover, the supply and return conduits 168 and 170 extending between the valve 156 and the actuator 26 are also provided with adjustable needle type flow control valves 172 which each include bypass check calves for free flow of return fluid. The valves 172 are adapted for selectively adjusting the speed of the upstroke and downstroke of the actuator 26. In accordance with the type of formation 124 being pumped and the characteristics of the pumped fluid it may be desirable to time the respective up and down strokes of the actuator 26 by controlling the flow of fluid to the respective chambers 153 and 151 so that, for example, the downward stroke of the piston 32 is slower than the upward stroke or vice versa. The terms upward and downward are used for convenience herein with respect to the normal arrangement of the actuator 26 and the preferred embodiment of the well pumping unit 10.

The pilot valves 160 and 162 are electric solenoid type and are preferably energized through respective pneumatic-type time delay relays 180 and 182, respectively. The relays 180 and 182 are connected to a source of electrical energy, not shown, through a conventional fused main line disconnect switch 184 and are adapted to momentarily energize the solenoid actuators of the valves 160 and 162, respectively, to effect shifting of the directional control valve 156. For example, energization of the relay 180 will effect shifting of valve 160 from its position a to its position b to effect shifting of the valve 156 to its position a, which will move the actuator 26 on a down stroke and lift the counterweight 82. The valve 160 is held in its position b until a suitable pneumatic time delay signal causes the relay 180 to de-energize the solenoid actuator of valve 160 whereupon valve 160 then returns to its position a. In like manner the relay 182, when electrically energized, shifts valve 162 from its position a to its position b to shift the valve 156 to its position b to effect movement of the actuator 26 on a lifting stroke of the pump rod string 138.

A three-position, spring centered selector swtich 184 is in circuit with the relays 180 and 182 and with the solenoid actuators of the valves 160 and 162 as illustrated. A normally closed pressure actuated switch 186 is in communication with the hydraulic fluid supply conduit 164 and is in circuit with the relay 180 to effect shifting of the valve 156 on start up of the pump unit 10 so that the actuator 26 moves the pump rod string 138 in a downward pump filling stroke direction to prevent improper cyclic operation of the system. The switch 186 is of a type commerically available and the relays 180 and 182 are also of a type commercially available such as a type CR2820B, series A, manufactured by General Electric Company, Bloomington, Ill.

The relays 180 and 182 are each momentarily actuated to effect actuation of the pilot valves 160 and 162 by respective proximity switches 188 and 190 suitably mounted on the mast 14 and adapted to be energized, respectively, by a suitable member 192, FIG. 8A, of magnetic material and mounted on the counterweight 82, for example. The proximity switches 188 and 190 are connected to switch 184 via conductors 183 and 185. Accordingly, as the counterweight 82 moves downwardly during a lifting stroke of the actuator 26, and upon movement of the member 192 into proximity of the switch 188, the relay 180 is energized to effect shifting of the valve 156 to position a to vent hydraulic fluid from the chamber 153 and supply hydraulic fluid to the chamber 151 of the actuator 26 to terminate the lifting stroke of the actuator and move the actuator in the opposite direction lowering the pump rod string 138 and raising the counterweight 82.

As the counterweight 82 and the member 192 move into proximity of the switch 190 the relay 182 is energized to effect shifting of the valve 156 to its position b to terminate the downward stroke of the actuator 26 and commence a lifting stroke of the actuator and the pump rod string. Thanks to the provision of the time delay actuator mechanisms of the relays 180 and 182 these relays are held in their positions, respectively, for energizing the associated valves 160 and 162 for a selected predetermined time period so that the valve 156 is positively shifted from one position to the other to effect a gradual acceleration and deceleration of the actuator 26 and the pump rod string. This combination of control elements together with the valve 156 also provides for a reduced shock load on the actuator 26 during change of direction.

The control system illustrated in FIGS. 8A and 8B includes exemplary components such as a commercially available motor starting unit 192, and a single-phase to three-phase power converter 194 in circuit with the motor 152. The motor starter 192 may be operated through a three-position selector switch 196 and a manual start switch 198 for manual starting of the motor 152 when the switches 196 and 198 are in proper position. Alternatively, the pumping unit 10 may be operated automatically to shut off on sensing an increased lifting effort by the actuator 26 which would be indicative of pumping down the fluid level in the casing 122 to a level which would desirably result in shut off of the pumping unit 10 for a predetermined period of time to provide for restoration of a suitable fluid level in the casing through inflow of formation fluids from the formation 124 to the casing annulus. In this regard the control system of the present invention is provided with a timing circuit, generally designated by the numeral 200 which includes switches 202, 204 and 206. The circuit 200 may be of a type commercially available from G & W Eagle Signal, Davenport, Iowa as their HP5 Series Reset Timer. The switch 206 comprises part of a reset timer device 208 which is in circuit with the switch 204 and a normally open pressure actuated switch 210. The switch 210 is adapted to sense fluid pressure in the conduit 170 which, during a lifting stroke of the actuator 26, is proportional to the lifting effort of the pumping unit 10. Accordingly, the switch 210 may be set to close at a predetermined pressure indicating an increased load on the well pumping unit 10 and a reduced level of fluid in the casing 122 to shut down the operation of the actuator 26 for a predetermined time period as controlled by the timer circuit 200.

For example, with the switch 196 in the position shown to provide for automatic operation of the motor starter 192 the switch 202 is normally closed and the swich 210 is normally open. In the above described position the starter 192 is energized to energize the motor 152. Upon sensing a predetermined pressure in the conduit 170 by way of a conduit 171 during a lifting stroke of the actuator 26 the switch 210 will close to effect opening of the switch 202 and closure of the switch 204. With the switch 206 in the position shown closure of the switch 210 will energize a solenoid 203 to open switch 202 and close switch 204 which will effect energization of the timer 200 to commence a predetermined timing cycle. Opening of the switch 202 will de-energize the motor starter 192 shutting down the motor 152 until a predetermined time interval elapses to effect reclosure of the switch 206, reopening of the switch 204 and reclosure of the switch 202 thereby re-energizing the motor 152. Accordingly, the control system thus far described is operable to sense the effective lifting effort of the actuator 26 and shut down the operation of the pumping unit 10 during an upward stroke of the polish rod 38 until a suitable fluid column height in the casing 122 is restored. If the refilling time of the casing 122 should vary the pumping unit 10 will nonetheless cease operation when the fluid level has been pumped down to a point wherein the effective fluid column height acting on the piston 134 to assist in the lifting effort of the actuator 26 has decreased.

The pumping unit 10 and the associated control system illustrated in FIGS. 8A and 8B includes further improvements which minimize the operating costs of the pumping unit by adjusting the effective weight of the counterweight 82 in accordance with sensing the working pressures in the opposed cylinder chambers 153 and 151 of the actuator 26. The effective weight of the counterweight 82 is adjusted to provide the balancing effort previously mentioned to compensate for changes in the effective density of the fluid being pumped, for example, by filling or emptying the counterweight tank 90 through operation of the reversible pump 148. The pump 148 is driven by a reversible electric motor 220 which is suitably connected to the electrical source associated with the control system for operation in one or the other directions to effect filling or emptying of the counterweight tank 90.

The motor 220 is connected to the electrical source through a spring centered selector switch 222, a 3-pole, double throw relay 224, 3-position, spring centered selector switches 226 and 228 and a single pole double throw relay 230. The switches 226 and 228 are operated by an actuator handle 232 to provide for selective control of operation of the motor 220 in one direction or the other to effect an increase or decrease in the effective weight of the counterweight 82. The switch 222 is connected via conductors 223 and 225 to the aforementioned electrical source by way of switch 210 and is adapted to provide for automatic or manual operation of the counterweight control portion of the control system. Relays 224 and 230 are interposed in the circuit as illustrated to provide a proper interconnected between the electrical source and the motor leads to prevent short circuiting of the motor 220 during manual operation of the counterweight control regardless of the condition of an automatic portion of the control circuit to be described hereinbelow.

Figure 9:
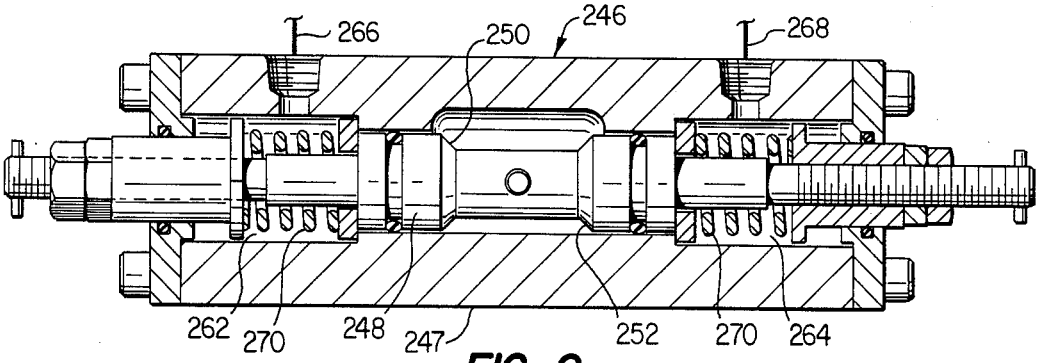
FIG. 9 is a central section view of the pressure comparator unit included in the control system of the present invention.

Referring further to FIG. 8A and FIG. 9 the unique variable counterweight control system is adapted to sense pressures proportional to the pressures in the cylinder chambers 151 and 153 by way of respective conduits 240 and 242 which are respectively connected to pilot-to-open vented type check valves **244*a* and 244*b* and a pressure comparator unit, generally designated by the numeral 246. The conduits 240 and 242 communicate the working fluid pressures sensed by the pilot actuators 157 and 159 which are proportional to the pressures in the actuator 26 when the respective valves 162 and 160 are shirted to their positions b and are in communication with the conduits 168 or 170 through conduit 158**.

The pressure comparator unit 246 includes a housing 247 in which is disposed a reciprocable cam 248 having opposed cam surfaces 250 and 252 which are adapted to actuate roller lever type snap acting switches 254 and 256, respectively, each having respective cam followers 255. For example, upon sensing a relatively higher pressure in conduit 168 the comparator cam 248 tends to move to the right, viewing FIG. 8A, to move the switch 254 to effect operation of the motor 220 and the pump 148 to pump fluid out of the tank 90 to reduce the effective weight of the counterweight 82. During automatic operation of the control system the relay 224 would be energized to move its respective switch contacts to the positions shown in the drawing figure so that upon movement of the switch contacts of the switch 254 to the alternate position shown the motor 220 would be energized to run in the prescribed direction to effect emptying of the tank 90 by the pump 148. On the other hand, if a pressure imbalance occurs which creates a higher than predetermined pressure in the conduit 170 the comparator cam 248 would tend to move to the left, viewing FIG. 8A, to effect actuation of the switch 256 to run the motor 220 in the opposite direction to add fluid to the counterweight tank 90 thereby increasing the effective weight of the counterweight.

Referring also to FIG. 9, the pressure comparator housing 247 is bored for receiving the comparator cam 248 which is configured as a double ended piston slidably disposed in the housing and forming therewith opposed chambers 262 and 264. The chambers 262 and 264 are in communication with the respective pilot operated check valves **244*a* and 244*b* through conduits 266 and 268, FIG. 8A, which may comprise flexible hydraulic hoses. The cam actuator piston 248 is centered by opposed adjustable springs 270 so that the effective working pressures in the chambers 262 and 264, tending to move the comparator cam in one direction or the other, can be modified by adjustment of the spring forces acting on the comparator cam. The pilot operated check valves 244*a* and 244*b* are arranged in circuit with a shuttle valve 245 as illustrated in FIG. 8A. The inlet ports and pilot actuators of the respective check valves 244*a* and 244*b* are also connected to the conduits in communication with the respective conduits 168 and 170**.

When the pumping unit 10 is operating in a manner such that the counterweight 82 is properly balancing the weight of the pump rod string 138 and the column of fluid being lifted the working pressures in the conduits 168 and 170 will be essentially balanced or within prescribed differentials during respective downstrokes and upstrokes of the piston 32 of the actuator 26. However, for example, if the density of the fluid column being lifted through the production tube 128 should decrease, thereby causing the effective weight of the counterweight 82 to be excessive the pressure in the conduit 168 will increase relative to the conduit 170 during reciprocation of the pumping unit actuator 26.

The chambers 262 and 264 are operable to sense fluid pressure signals proportional to the respective working pressures in the conduits 168 and 170 when pressure fluid is being supplied to the actuator 26 through these respective conduits. For example, during supply of pressure fluid from the valve 156 through the conduit 168 the check valve **244*a* associated with conduit 240 is opened and fluid pressure proportional to the working pressure in conduit 168 is sensed in chamber 262. During the time that check valve 244*a* associated with conduits 240 and 266 is opened the other check valve 244*b* associated with conduits 242 and 268 is held closed trapping fluid in the chamber 262. Accordingly, during operation of the pumping unit 10, if a higher fluid pressure is sensed in chamber 262 during supply of pressure fluid to conduit 168 the comparator cam 248 will be biased to move to the right, viewing in FIG. 8A, but is prevented from doing so by the fluid trapped in chamber 264**.

When the direction of valve 156 is reversed to supply pressure fluid to conduit 170 and vent conduit 168 check valve **244*b* is opened and check valve 244*a* is closed. The valves 244*a* and 244*b* are opened each time pressure fluid at working or supply pressure is supplied to the respective conduits 168 and 170 even though the working pressure may be different from the previous operating cycle. Any imbalance in the pressures in the chambers 262 and 264 will tend to move the piston type cam 248 in the direction to correct the balance. The cam 248 is preferably moved incrementally with each actuating stroke of the actuator 26 such as by taking advantage of the fluid accumulator or expansion effect provided by the flexible hydraulic hose type conduits 266 and 268. If an imbalance in the working pressures in the conduits 168 and 170 occurs as described above, through incremental movement of the cam 248 with each successive reversal of the operating cycle of the actuator 26, the cam will move to the right to effect closure of the switch 254 and energization of the motor 220 to pump fluid out of the tank 90 until a prescribed or predetermined balance is achieved between the working pressures in the conduits 168 and 170**.

Those skilled in the art will appreciate that, if the pressure in the conduit 170 increases above a predetermined differential between the working pressures in the conduits 170 and 168, repeated operating cycles of the actuator 26 will result in incremental movement of the comparator cam 248 to the left, viewing FIG. 8A, until the switch 256 is closed to effect energization of the motor 220 to run in the opposite direction to pump fluid into the counterweight tank 90 until the effective weight of the counterweight increases. When the cam 248 is again restored to its centered position both switches 254 and 256 will be in respective positions which will not energize the motor 220.

The control system illustrated in FIGS. 8A and 8B further includes a manually actuated spring centered four-way directional control valve 270 for operating the mast elevating and reclining jacks 44. A second shuttle valve 245 may be connected in circuit with the hydraulic lines leading to and from the jacks 44 and be in circuit with the shuttle valve 245 associated with the check valves **244*a* and 244*b* and with the pump pressure compensator or load sensing control for the pump 150**.

The operation of the control system described above is believed to be readily understandable to those skilled in the art from the description herein and the circuit diagram of FIGS. 8A and 8B. However, a typical operating sequence for start-up and automatic operation of the control system will now be described. If the switch 196 is placed in the automatic start position and the timing circuit 200 is positioned to effect a start up of the motor 152 through the motor starter 192 the pump 150 will supply pressure fluid through the conduit 164 to the directional control valve 156. Since the pressure switch 186 is normally closed and the relay 180 in a position to shift the directional control valve 156 to its position a the actuator 26 will always start in a direction to move the rod string 138 in a downward direction. As soon as the pressure in the conduit 164 reaches a nominal working pressure the switch 186 opens to place the relays 180 and 182 in automatic operation.

As the actuator 26 moves downward to its limit position provided by the movement of the magnetic member 192 into proximity of the switch 190, the relay 182 is energized to effect shifting of the valve 156 to its position b through operation of the pilot valve 162. The direction of movement of the actuator piston 32 is thus reversed and the pumping unit 10 operates on an upward or fluid lifting stroke. During automatic operation of the control system the switch 222 is normally set in the automatic operating position to effect energization of the relay 224 so that its switch contacts are in the position shown in the drawing figure. Any imbalance in the working pressures sensed in conduits 168 and 170 will effect incremental movement of the comparator cam 248 to effect operation of the counterweight fluid pump 220 to correct the undesired working pressure differential acting on the actuator 26. If the working pressure sensed in the conduit 170 reaches a predetermined limit position the switch 210 will close to effect shut-off of the pump motor 152 and commencement of a timing cycle as determined by the timer 208. The components in the control circuit illustrated in FIGS. 8A and 8B are commercially available and known to those skilled in the art with the exception of the pressure comparator unit 246. However, the combination of elements provided by the control system described above is believed to provide a unique operating system for well pumping units and the well pumping unit 10, in particular.

Figure 10:
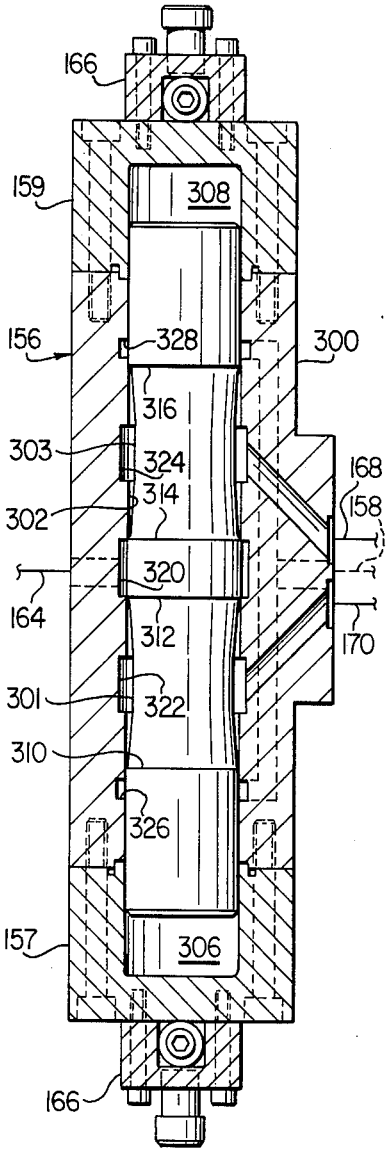
FIG. 10 is a longitudinal section view of an improved control valve for the control system.

Still further in accordance with the present invention the directional control valve 156 is of unique construction. Referring now to FIG. 10 the control valve 156 includes a valve housing 300 defining a bore 302 in which a valve spool 304 is slidable. The housing 300 includes opposed pilot chambers 306 and 308 through which pilot fluid may be supplied by the respective valves 160 and 162. The configuration of the lands 301 and 303 of spool member 302 is such that they are progressively of smaller diameter away from opposed shoulders 310 and 312 and 314 and 315, respectively. Accordingly, as the spool member 302 shifts from one working position to the other to selectively place the supply port 320 in communication with transfer ports 322 or 324 and these latter ports in communication with the fluid return ports 326 or 328, respectively, the fluid flowing between the fluid inlet ports and the working ports provides for uniform acceleration and deceleration of the cylinder actuator piston 32. In this way shock loads on the pumping unit 10 and the pump rod string 138 as well as the subsurface pump 130 are minimized for operation of a direct acting type hydraulic cylinder actuator such as the actuator 26.

Referring now to the fragmentary central longitudinal section view of the pumping unit 10 illustrated in FIG. 7, the actuator 26 is supported on the mast 14 in such a way that the resultant force acting on the actuator during an upstroke of the piston 32 to lift the pump rod string may be measured. The cylinder head 29 includes a body member 400 which is threadedly connected to a cap member 402 having an annular groove 404 forming a pressure fluid chamber. A stationary annular piston 406 is supported on the support plate 30 and forms a closure for the groove 404 and the chamber delimited thereby. Accordingly, the reaction force exerted on the cylinder actuator 26 during a lifting stroke of the piston 32 may be sensed through a conduit 408 suitably in communication with the chamber formed by the groove 404 and which chamber is filled with a suitable hydraulic fluid. As shown in FIG. 7 the lower end of the actuator 26 is guided by the support plate assembly 22 but is not rigidly secured thereto. The lower cylinder head 27 includes a peripheral flange 410 which supports a plurality of spaced apart guide bushings 412. Suitable guide pins 414 extend through the bushings 412 and are threadedly secured to the support plate assembly 22 to permit limited free movement of the actuator 26 longitudinally with respect to the axis 39.

The conduit 408 is operably connected to respective of-off valves 416, 418 and 420 as illustrated by the schematic diagram portion of FIG. 7. The valve 420 is adapted to be in communication with a source of charging fluid, not shown, by way of a conduit 422. A conduit portion 424 interposed between the valves 418 and 420 is connected to a conduit 426 which is suitably connected to a pressure gauge 428 and may also be in communication with a suitable recording instrument, not shown. A conduit 430 may be suitably connected to the load sensing control mechanism for the pump 150 illustrated in FIG. 8B. A fourth on-off valve 432 is part of the control circuit illustrated in FIG. 7 and is in circuit with the conduit 426.

The anchor members 102 for the chains 92 are each connected to a support plate 436 by respective threaded members 438, two shown in FIG. 7. It will be appreciated that if three chains 92 are provided for the preferred embodiment of the invention illustrated that a third anchor member 102 and connecting member 438 is also secured to the support plate 436. A stepped piston member 440 is secured to the crown plate 24 and includes a first annular piston portion 442 and a second piston portion of smaller diameter designated by the numeral 444. The support plate 436 and a removable cap member 456 form respective fluid chambers 448 and 450 with the piston member 440. The chamber 448 is in communication with a conduit 452 connected to the valve 432 and the chamber 450 is in communication with a conduit 454 which is connected to the valve 416 and may be placed in communication with the conduit 408 as illustrated by the position of valve 416 in FIG. 7. For the particular arrangement of the pumping unit 10 illustrated, the effective cross-sectional area of the piston portion 444 measured in a plane normal to the axis 39 is one-half the effective cross-sectional area of the piston member 406 exposed to the chamber formed by the groove 404. The annular cross-sectional area of the piston portion 442 exposed to the chamber 448 and lying in a plane normal to the axis 39 is equal to the aforementioned effective area of the piston portion 444.

The arrangement of load sensing chambers 404, 448 and 450 described above provides for sensing the total effective load on the polish rod, the effective counterweight load and the effective load on the cylinder actuator 26. During a lifting stroke of the piston 32, for example, the pressure sensed in the chamber 404 is transmitted through the conduit 408, the valve 416 in its position shown, through the conduit 454 to the chamber 450. The effective load on the chains 92 combined with the reaction force exerted on the cap member 46 due to the pressure in the chamber 450 provides a pressure in the chamber 448 which is sensed through the conduit 452, the valve 432 and by the pressure gauge 428 or by a suitable recording instrument connected to the conduit 426. Accordingly, the total load on the polish rod 38 and the rod string connected thereto may be sensed with a unique hydraulic load sensing mechanism provided by the load sensing fluid chamber 404 of the cylinder actuator 26 and the respective chambers 448 and 450 provided by the support member 436 and the cylinder formed therewith by the member 446. In this way suitable dynamometer readings may be obtained during continuous operation of the pumping unit 10.

In the positions of the respective valves 416, 418, 420 and 432, illustrated in FIG. 7, the total load on the polish rod 38 may be read directly by the gauge 428, particulary if, for example, the effective cross-sectional area of the chamber 404 is 10 square inches and the effective cross-sectional areas of the chambers 448 and 450 are respectively 5 square inches each. If it is desired to measure the load on the cylinder actuator 26 only, valve 420 is maintained in the position shown in FIG. 7, valves 416 and 432 are turned to their off positions and valve 418 is turned to place conduit 424 in communication with conduit 408. If it is desired to measure the loads exerted by the counterweighy only, the valves 416, 418 and 420 are turned to their off positions and only valve 432 is left in the position shown. For charging pressure fluid into the hydraulic load cell system illustrated in FIG. 7 the valve 420 is placed in a position to permit flow of fluid from a source through conduit 422 and selectively moving the valve 416 or the valve 432 to their off positions.

Although a preferred embodiment of a pumping unit and a control system therefor has been described in accordance with the present invention those skilled in the art will recognize that various substitutions and modifications may be made to the specific embodiment described without departing from the scope and spirit of the invention as recited in the appended claims.

What is claimed is:

1. In a well pumping unit for actuating a pump rod string connected to a subsurface pump:

a hydraulic fluid operated actuator including means forming opposed fluid chambers and means connecting said actuator to a pump rod string;

means for operating said actuator to reciprocate said pump rod string comprising a source of pressure fluid, a directional control valve operably connected to said opposed fluid chambers in said actuator for selectively valving fluid to said actuator to effect reciprocation of said pump rod string;

pilot valve means in communication with said source of pressure fluid for operating said directional control valve to effect operation of said actuator;

time delay relay means operable to control movement of said pilot valve means to move said directional control valve from one position to the other;

switch means responsive to the movement of the actuator in opposite directions to effect actuation of said relay means to control said pilot valve means; and pressure switch means interconnected with said relay means and operable to effect positioning of said directional control valve on starting of said actuator to move said actuator in a predetermined direction of said pump rod string, said pressure switch means being responsive to increasing pressure in a conduit connected to said actuator to become inoperable to effect operation of said relay means upon increasing pressure in said conduit.

2. A well pumping unit for actuating a pump rod string conncted to a subsurface pump comprising:

an elongated mast;

means for supporting said mast generally above a wellhead;

a hydraulic cylinder actuator supported on said mast and including a cylinder, piston means, a lower piston rod connected to a pump rod and an upper piston rod extending within said mast;

sheave means supported on said mast above said upper piston rod;

at least one elongated flexible member operably connected to said upper piston rod and trained over said sheave means; and counterweight means connected to said at least one flexible member and movable along said mast in opposite directions to the movement of said upper piston rod to counteract the weight of said pump rod string.

3. In a well pumping unit for actuating a pump rod string connected to a subsurface pump:

a hydraulic fluid operated actuator including means forming opposed fluid chambers and means connecting said actuator to a pump rod string;

means for operating said actuator to reciprocate said pump rod string comprising a source of pressure fluid, a directional control valve operably connected to said opposed fluid chambers in said actuator for selectively valving fluid to said actuator to effect reciprocation of said pump rod string;

pilot valve means in communication with said source of pressure fluid for operating said directional control valve to effect operation of said actuator;

time delay relay means operable to control movement of said pilot valve means to move said directional control valve from one position to the other;

switch means responsive to the movement of said acutator in opposite directions to effect actuation of said relay means to control said pilot valve means;

counterweight means connected to said actuator for balancing at least part of the weight of a fluid column being lifted by said pumping unit, said counterweight means including a tank for receiving liquid;

conduit means interconnecting said tank with a source of liquid;

a pump for pumping liquid between said source and said tank;

motor means for operating said pump; and control means responsive to a predetermined differential pressure between the working pressures of said chambers in said actuator for changing the effective weight of said counterweight means by adding fluid to or removing fluid from said tank.

4. The pumping unit set forth in claim 3 wherein:

said control means for changing the effective weight of said counterweight means includes a pressure comparator for sensing the pressure in said chambers in said actuator during respective strokes of said pump rod string, said comparator including a piston for sensing the respective pressures in said chambers in said actuator and for effecting operation of said pump to add or remove fluid from said tank.

5. A well pumping unit for actuating a pump rod string connected to a subsurface pump comprising:

a hydraulic cylinder actuator having a piston forming opposed fluid chambers, said piston including a piston rod connected to said pump rod string;

means for supplying pressure fluid to said chambers; and counterweight means connected to said actuator for movement to counteract the weight of said pump rod string, said counterweight means comprising a tank for receiving liquid, conduit means interconnecting said tank with a source of liquid, pump means for pumping liquid between said source and said tank, means for operating said pump means, and control means for changing the effective weight of said counterweight means by pumping fluid to or from said tank.

6. The pumping unit set forth in claim 5 including:

pump means for supplying pressure fluid from said source to said cylinder actuator, a motor for driving said pump means, a control circuit for energizing said motor, and a pressure switch for sensing the pressure in said cylinder actuator during a stroke of said cylinder actuator to lift said pump rod string to effect operation of said control circuit to de-energize said motor at a predetermined pressure commensurate with a predetermined lifting effort of said cylinder actuator.

7. The pumping unit set forth in claim 5 wherein:

said control means for changing the effective weight of said counterweight means includes a pressure comparator for sensing the working pressures in said opposed chambers during respective strokes of said cylinder actuator and for effecting operation of said pump to add or remove fluid from said tank.

8. The pumping unit set forth in claim 7 wherein:

said comparator includes a piston movable incrementally with respective strokes of said actuator and operable to actuate switch means for controlling the operation of said pump to change the effective weight of said counterweight means.

9. The pumping unit set forth in claim 5 wherein:

said means for supplying pressure fluid includes conduit means connected to said opposed chambers and to a directional control valve; and flow control means interposed in said conduit means for controlling the rate of flow of fluid to respective ones of said chambers to selectively control the rate of movement of said pump rod string in at least one direction.

10. The pumping unit set forth in claim 9 including:

means for operating said directional control valve to effect operation of said cylinder actuator comprising time delay relay means operable to control movement of said directional control valve from one position to the other; and switch means responsive to the movement of said cylinder actuator in opposite directions to effect actuation of said relay means.

11. The pumping unit set forth in claim 9 including:

pressure switch means interconnected with at least one of said relays and operable to effect positioning of said directional control valve on starting of said cylinder actuator to move said cylinder actuator in a predetermined direction of said pump rod string.

12. A well pumping unit for actuating a pump rod string connected to a subsurface pump comprising:

an elongated mast adapted to be supported generally above a wellhead;

a hydraulic cylinder actuator supported on said mast and including a cylinder, piston means, a lower piston rod connected to a pump rod and an upper piston rod;

counterweight means diposed around said mast for movement to counteract the weight of said pump rod string; and means interconnecting said upper piston rod and said counterweight means.

13. The pumping unit set forth in claim 12 wherein:

said means interconnecting said counterweight means and said upper piston rod includes flexible members trained over sheave means supported on said mast and trained around sheave means connected to said upper piston rod.

14. The pumping unit set forth in claim 12 including:

a frame for supporting said mast generally above said wellhead; and means for moving said mast between an erect position and a reclining position with respect to said wellhead to permit access to said pump rod string.

15. The pumping unit set forth in claim 12 wherein:

said lower piston rod is threadedly connected to said pump rod string and is connected to said piston means disposed in said cylinder, said piston means is characterized by a first piston member slidably disposed in said cylinder and a second piston member connected to said lower piston rod and bearing means interposed between said first and second piston members and providing for rotation of said lower piston rod and said second piston member to provide for threadedly connecting said lower piston rod to and disconnecting said lower piston rod from said pump rod string without rotating said first piston member.

16. The pumping unit set forth in claim 12 wherein:

said counterweight means comprises a tank for receiving liquid, said pumping unit includes conduit means interconnecting said tank with a source of liquid, pump means for pumping liquid between said source and said tank, and control means responsive to a predetermined differential pressure between the working pressures of opposed fluid chambers in said actuator for changing the effective weight of said counterweight means by adding fluid to or removing fluid from said tank.

17. The pumping unit set forth in claim 16 wherein:

said control means for changing the effective weight of said counterweight means includes a control circuit including switch means for connecting a motor for said pump with a source of energy to drive said motor in one direction or the other, a pressure comparator operably connected to said switch means for sensing pressures in said chambers of said actuator during respective strokes of said cylinder actuator, said comparator including a piston for sensing the respective pressures in said chambers and for actuating said switch means to effect operation of said pump to add or remove fluid from said tank.

18. The pumping unit set forth in claim 12 including:

a frame for supporting said mast generally above said wellhead;

means interconnecting said mast with said frame and providing for limited movement of said mast relative to said frame to align said actuator with said pump rod string.

19. The pumping unit set forth in claim 18 wherein:

said means for aligning said mast includes a support plate, a plurality of threaded members interconnecting said support plate and said frame and a plurality of members cooperably with said threaded members for locating said mast in a predetermined position relative to said frame.

20. The pumping unit set forth in claim 12 including:

means for operating said actuator to reciprocate said pump rod string comprising a source of hydraulic fluid, a directional control valve connected to opposed pressure fluid chambers in said cylinder for reciprocating said piston means in opposite directions to effect reciprocation of said pump rod string;

conduit means interconnecting said directional control valve and said actuator, and flow control means interposed in said conduit means for controlling the rate of flow of fluid to respective ones of said chambers to selectively control the rate of movement of said pump rod string in at least one direction.

21. The pumping unit set forth in claim 20 including:

pump means for supplying pressure fluid from said source to said actuator, a motor for driving said pump means, a control circuit for energizing said motor, and a pressure responsive switch for sensing a pressure related to the load on said cylinder actuator during a pump rod lifting stroke of said actuator to effect operation of said control circuit to de-energize said motor at a predetermined lifting effort of said actuator.

22. The pumping unit set forth in claim 20 including:

pilot valve means in communication with said source of pressure fluid for operating said directional control valve to effect operation of said actuator;

time delay relay means operable to control movement of said pilot valve means to move said directional control valve from one position to the other; and switch means responsive to the movement of said actuator in opposite directions to effect actuation of said relay means to control said pilot valve means.

23. The pumping unit set forth in claim 22 including:

pressure switch means interconnected with at least one of said relay means and operable to effect positioning of said directional control valve on starting of said pumping unit to move said piston means in a predetermined direction of said pump rod string.

24. A well pumping unit for actuating a pump rod string extending into a wellbore comprising:

a hydraulic cylinder actuator including a cylinder, piston means disposed in said cylinder and having opposed piston piston rods extending from said cylinder, one of said piston rods being connected to said pump rod string;

support means for said cylinder;

counterweight means operably connected to the other of said piston rods for counteracting the weight of said pump rod string; and load sensing means operable to sense the lifting effort of said cylinder actuator on said pump rod string.

25. The pumping unit set forth in claim 24, wherein:

said load sensing means includes means for sensing a fluid pressure related to the working pressure of hydraulic fluid in said cylinder actuator to determine the lifting effect on said pump rod string.

26. The pumping unit set forth in claim 24 wherein:

said pumping unit includes means operable to sense the lifting effort of said counterweight means on said pump rod string.

27. The pumping unit set forth in claim 24 wherein:

said load sensing means includes means interposed between said support means and said cylinder actuator for sensing a reaction force exerted between said cylinder and said support means to determine the lifting effort of said cylinder actuator on said pump rod string.

28. The pumping unit set forth in claim 27 wherein: said load sensing means includes a hydraulic load cell comprising means forming a first fluid chamber and conduit means in communication with said first chamber for transmitting a fluid pressure signal from said first chamber for measuring the component of lifting effort exerted on said pump rod string by said cylinder actuator.

29. The pumping unit set forth in claim 28 wherein: said pumping unit includes flexible members connected to said support and to said counterweight means and operably interconnecting said upper piston rod with said counterweight means, and load sensing means interposed between said support and means for connecting said flexible members to said support for providing a signal related to the effective lifting effort of said counterweight means on said pump rod string.

30. The pumping unit set forth in claim 29 wherein: said means for connecting said flexible members to said support includes another hydraulic load cell means having a second chamber for generating a fluid pressure signal related to the force exerted on said pump rod string by said counterweight means and a third chamber operable to be connected to said first chamber for transmitting a fluid pressure signal from said first chamber to said another load cell means for causing a pressure signal to be generated in said second chamber related to the total lifting effort exerted on said pump rod string by said pumping unit.

31. The pumping unit set forth in claim 30 including: a control circuit including register means for registering signals generated by said load cell means, and means for selectively causing said register means to read a signal related to the lifting effort of said cylinder actuator, said counterweight means, and the sum of the lifting effort of said cylinder actuator and said counterweight means on said pump rod string, respectively.

32. The pumping unit set forth in claim 30 wherein: said another load cell includes a piston means connected to said support, means forming a cylinder member connected to said flexible members and forming with said piston member said second and third chambers.

* * * * *